US007971777B2

(12) United States Patent
Ha

(10) Patent No.: US 7,971,777 B2
(45) Date of Patent: Jul. 5, 2011

(54) CLOTHES TREATING APPARATUS

(75) Inventor: Mi Kyung Ha, Changwon-si (KR)

(73) Assignee: LG Electronics Inc., Seoul (KR)

( * ) Notice: Subject to any disclaimer, the term of this patent is extended or adjusted under 35 U.S.C. 154(b) by 334 days.

(21) Appl. No.: 12/285,696

(22) Filed: Oct. 10, 2008

(65) Prior Publication Data

US 2009/0134213 A1 May 28, 2009

(30) Foreign Application Priority Data

Oct. 12, 2007 (KR) ..... 10-2007-0103003

(51) Int. Cl.
*G06F 19/00* (2011.01)

(52) U.S. Cl. ..... 235/375

(58) Field of Classification Search ..... 235/375, 235/384, 376, 435, 439, 492
See application file for complete search history.

(56) References Cited

U.S. PATENT DOCUMENTS

| | | | | |
|---|---|---|---|---|
| 6,167,358 | A * | 12/2000 | Othmer et al. | 702/188 |
| 2002/0170952 | A1 | 11/2002 | Alsafadi et al. | |
| 2006/0150689 | A1 * | 7/2006 | Kim et al. | 68/236 |
| 2006/0152338 | A1 * | 7/2006 | Hsu | 340/5.5 |
| 2008/0116274 | A1 * | 5/2008 | Aldridge | 235/440 |
| 2008/0173716 | A1 * | 7/2008 | Itagaki | 235/439 |
| 2008/0283585 | A1 * | 11/2008 | Peterman et al. | 235/375 |

FOREIGN PATENT DOCUMENTS

| | | |
|---|---|---|
| DE | 10 2005 058 932 | 6/2006 |
| DE | 11 2005 001 272 | 5/2007 |
| EP | 1 225 267 | 7/2002 |
| EP | 1 501 975 | 12/2006 |
| EP | 1 744 248 | 1/2007 |
| WO | WO 2004/055256 | 7/2004 |

* cited by examiner

*Primary Examiner* — Seung H Lee
(74) *Attorney, Agent, or Firm* — McKenna Long & Aldridge LLP

(57) ABSTRACT

A clothes treating apparatus is disclosed. More particularly, the present invention relates to a clothes treating apparatus which includes a RFID reader capable of reading information of clothes with RF tags such that the information of the clothes may be identified via an external computer. According to the clothes treating apparatus, the RFID reader is used and the information on treating states or positions of the clothes is identified via an external computer or display device. As a result, it can be simple to manage each item of clothes. Furthermore, the information on the treating states of the clothes may be identified. As a result, troubles of treating the clothes again unnecessarily as well as fabric damage may be saved.

16 Claims, 3 Drawing Sheets

CLOTHES TREATING APPARATUS

CROSS REFERENCE TO RELATED APPLICATION

This application claims the benefit of the Patent Korean Application No. 10-2007-0103003, filed on Oct. 12, 2007, which is hereby incorporated by reference as if fully set forth herein.

BACKGROUND OF THE DISCLOSURE

1. Field of the Disclosure

The present invention relates to a clothes treating apparatus. More particularly, the present invention relates to a clothes treating apparatus which includes a RFID reader capable of reading information of clothes with RF tags such that the information of the clothes may be identified via an external computer.

2. Discussion of the Related Art

A clothes treating apparatus is typically an apparatus which supplies moisture to clothes accommodated in an accommodation compartment of a cabinet defining an external appearance thereof in order to remove unpleasant smell, wrinkles and humidity remaining on clothes. Such the clothes treating apparatus may be employed to be a kind of a closet simply accommodating clothes if it is turned off, rather than to treat quite an amount of clothes.

Due to the improvement of economical standards, the number of clothes-items purchased by people has been increasing. If such the clothes treating apparatus has a trend of being large sized accordingly, it may be difficult for a user to recognize a state or position of each piece of clothes.

In addition, since each piece of the clothes may be various in kinds of fabric, a method of treating each piece of the clothes may be various.

The user has no information whether a specific piece of clothes is treated after being put on or has to be treated and the user should memorize the information on each piece of the clothes.

However, if kinds of clothes have been more various and the number of clothes purchased by the user has been increasing, the user may have difficulty in remembering all the information of each corresponding treating method to each piece of the clothes or the information whether a specific piece of the clothes is treated or has to be treated.

SUMMARY OF THE DISCLOSURE

Accordingly, the present invention is directed to a clothes treating apparatus.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a clothes treating apparatus includes at least one accommodation compartment where clothes are accommodated, with RFID tags attached to the clothes, respectively; an air supply device ventilating air to the accommodation compartment; an operational control part controlling the air supply device; a RFID reader provided in the accommodation compartment to read information of the RFID tags attached to the clothes; and a RFID control part comprising a central processing unit receiving the information read by the RFID reader and operation information of the operational control part and a memory unit storing the operation information and a RFID operation program operated in the operational control part.

The clothes treating apparatus may further include a communication device capable of transmitting the information read by the RFID reader outside, wherein the RFID operation program supports a communication function.

The communication device may be a LAN card via which the information read by the RFID reader is transmitted to an external information receiving device.

The external information receiving device may be a personal computer (PC).

The information stored in the RFID control part may include information on positions or treatment states of the clothes.

The LAN card may be connected with the internet and the information stored in the RFID control part is inspected via the personal computer connected with the internet.

The clothes treating apparatus may further include a moisture supply device controlled by the operational control part, the moisture supply device supplying moisture into the accommodation compartment.

The clothes treating apparatus may further include a display device displaying the information stored in the RFID memory part.

The display device may be a liquid crystal display, the liquid crystal display mounted at a door opening and closing the accommodation compartment.

At least two accommodation compartments may be provided and a RFID reader is installed in each of the at least two accommodation compartments.

One of the at least two accommodation compartments may be configured of a shield room.

In another aspect, a clothes treating apparatus includes at least one accommodation compartment where clothes are accommodated, with RFID tags attached to the clothes, respectively; an air supply device ventilating air to the accommodation compartment; a moisture supply device supplying moisture to the accommodation compartment; a RDID reader installed in the accommodation compartment; and a control part storing information read by the RFID reader, the controlling part controlling the air supply device and the moisture supply device.

Here, the moisture supply device may be a steam generation device.

The clothes treating apparatus may further include at least one of a display device displaying the information read by the RFID reader and a communication device transmitting the information stored in the control part to an external information receiving device.

The air supply device may dehumidify or heat air inside the accommodation compartment, with circulating the air.

According to the clothes treating apparatus, the RFID reader is used and the information on treating states or positions of the clothes is identified via an external computer or display device. As a result, it can be simple to manage each item of clothes. Furthermore, the information on the treating states of the clothes may be identified. As a result, troubles of treating the clothes again unnecessarily as well as fabric damage may be saved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
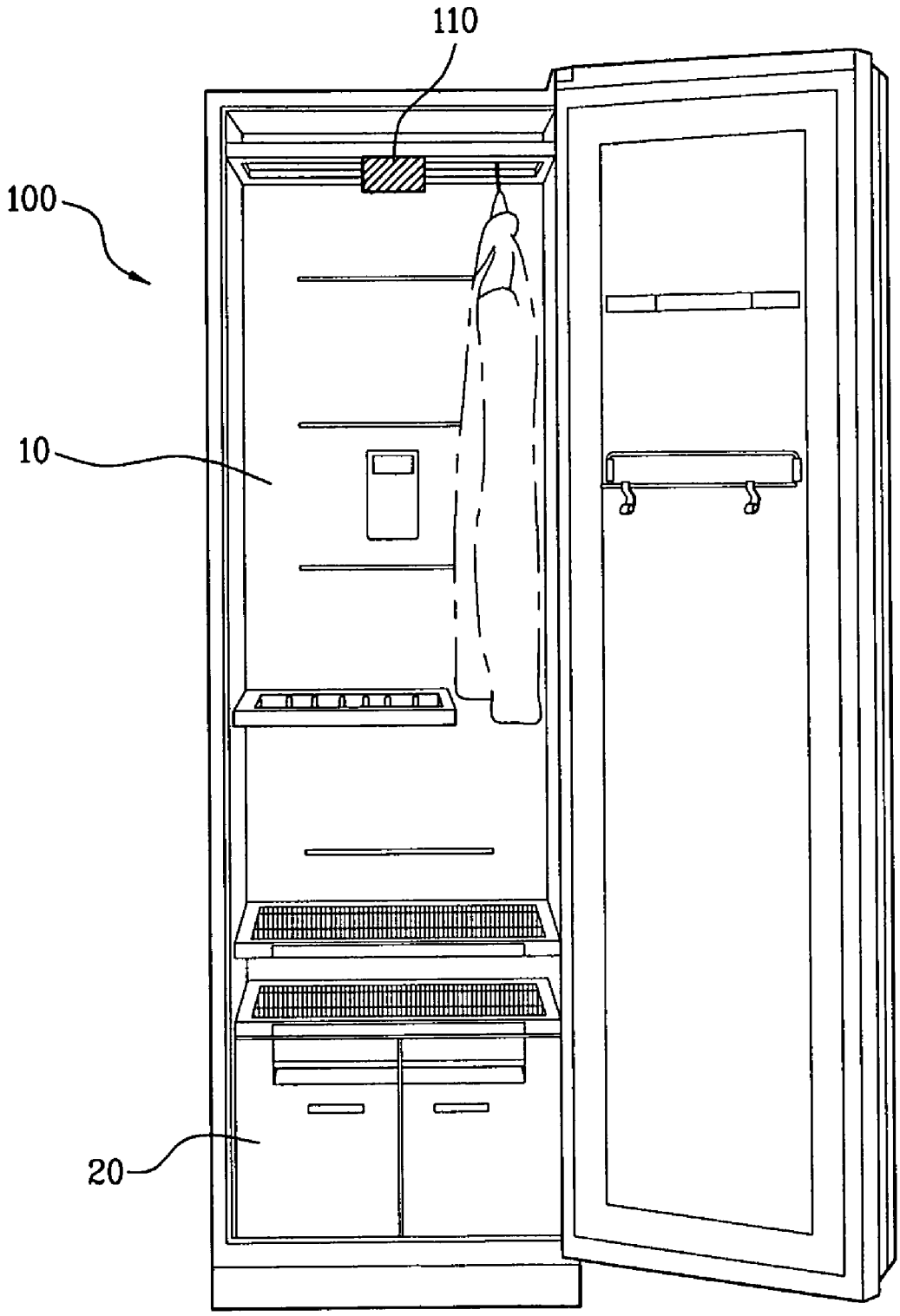
FIG. 1 is a perspective view illustrating a clothes treating apparatus according to an exemplary embodiment.

FIG. 1 is a perspective view illustrating a clothes treating apparatus 100 according to an exemplary embodiment. The clothes treating apparatus 100 may be configured of a cabinet type having an accommodation compartment 10 where clothes are accommodated. The accommodation compartment 10 is provided in an upper portion of the cabinet and a mechanism compartment 20 is provided in a lower portion of the cabinet. In the mechanism compartment 20 may be provided a moisture supply device supplying moisture to the accommodation compartment 10 and an air supply device supplying heated air or high temperature air to the accommodation compartment 10.

The moisture supply device may be a spray device which sprays minute water elements or a steam generation device which heats water to generate steam so that the generated steam may be supplied to the accommodation compartment 10. If the steam generation device is used as the moisture supply device, unpleasant smell and wrinkles remaining on the clothes may be removed efficiently.

The air supply device may be a ventilation device including a heat pump or an electric heater, for example. Here, the air supply device may circulate air inside the accommodation compartment 10. Also, the air supply device may remove the humidity contained in the air inside the accommodation compartment 10 and heat the air.

If the air supply device includes a heat pump, an evaporator composing the heat pump dehumidifies the circulated air of the accommodation compartment 10 and a condenser composing the heat pump heats the dehumidified air. At this time, an electric heater may be further provided and the air supply device may be configured of an air exhaustion type which exhausts the damp air of the accommodation compartment 10 outside.

If the same clothes are put on more than one time, unpleasant smell, wrinkles and humidity may remain on the clothes. A user trying to put on the same clothes again may feel unpleasant because of them. To remove them, the user should unnecessarily wash the clothes which results in short usage life as well as high maintenance cost of the clothes.

Moreover, even if the clothes have been washed and dried, wrinkles may still remain on the clothes. As a result, the user cannot put on the clothes again immediately and should press the clothes additionally as well as inconveniently.

To solve the problem, the clothes treating apparatus according to the embodiment may be usable to remove unpleasant smell, wrinkles and humidity remaining on the clothes.

For that, the clothes treating apparatus supplies moisture to the clothes and ventilates heated or hot air to dry the damp clothes.

The unpleasant smell, wrinkles and humidity may be effectively removed only by the supplying of the heated or hot air but moisture may be used to maximize the effect of the above removal.

For example, the moisture supplied to the clothes may be steam or sprayed water.

If the moisture is supplied to the clothes accommodated in the accommodation compartment, minute water elementary particles are combined with smell particles remaining deeply in fabric of the clothes and the combined water elementary particles are separated from the clothes in a drying course. In such the process, the unpleasant smell remaining on the clothes may be removed.

If the moisture is supplied to the clothes accommodated in the accommodation compartment, wrinkles remaining on the clothes also may be removed. The moisture supplied to the clothes may be removed during the drying course. Such the drying is performed by the simple ventilation of air or the ventilation of hot air.

Through the above processes, the unpleasant smell, wrinkles and humidity may be removed and the user may put on the clothes with more pleasant feeling.

In the meanwhile, the clothes treating apparatus according to the embodiment includes a RFID system configured of a RFID tag and a RFID reader. The RFID system is referenced to as a radio frequency identification system which is a contactless identification system for transmitting and processing information of things and environments by using a micro-semiconductor chip.

Different from a barcode, this RFID system is evaluated to replace a barcode because of its advantage in that direct-contact or scanning is unnecessary.

The RFID system is configured of a reader, RFID tag with private information, RFID reader, operation software and network. The RFID system identifies a flat-shaped tag attached to a thing and processes the information of the RFID tag.

The RFID tag includes a semiconductor transponder chip and antenna. The RFID tags may be categorized into passive RFID tags and active RFID tags. The passive RFID tag receives energy from a radio wave signal of a reader to operate. In contrast, the active RFID tag has a RFID tag battery mounted therein and it operates itself. The RFID tags may be categorized into chipped tags which use silicon chips and chipless tags configured of LC, plastic or polymer elements.

An auxiliary power does not have to be supplied to the passive RFID tag and thus it is convenient if the clothes treating apparatus according to the embodiment uses the passive RFID tag.

According to RFID technology, scanning within a visible band or direct contact of a barcode is unnecessary. Because of this advantage, the RFID technology has been more popular, evaluated to replace the barcode.

Low radio frequency identification system (30 kHz~500 kHz) may transferable in a relatively short distance not exceeding 1.8 m and high radio frequency identification system (850 MHz~950 MHz or 2.4 GHz~2.5 GHz) is transferable in a relatively long distance exceeding 27 m.

According to the clothes treating apparatus, a RF tag is attached or secured to each piece of the clothes to identify information on treatment states and positions of the clothes.

There may be two methods of attaching or securing the RF tag to the clothes, including that the RF tag is attached to the clothes in their production lines and that the RF tag is secured to the clothes by users later.

If private information of clothes is memorized in a RF tag and the RF tag is attached to the clothes in their production lines, a user who has purchased the clothes with RF tags may identifies the clothes treatment and position information via the clothes treating apparatus according to the embodiment, without additional work.

On the other hand, manufacturers of clothes treating apparatus may provide a plurality of tags with a user and the user attaches the tags to the clothes additionally.

In this case, the user may attach the tags provided when purchasing a clothes treating apparatus to clothes. At this time, it is preferable that the manufacturer of the clothes treating apparatus provides the tags with the users, with the tags having their private numberings.

If the user attaches the RF tags to the clothes after, it is necessary to store a relation between each RF tag and a piece of clothes having each corresponding RF tag in a manager program installed in a computer 200 which will be described later. At this time, the private number of each RF tag and the private information of the clothes having the RF tags attached thereto may be inputted in the manager program only one time.

Figure 2:
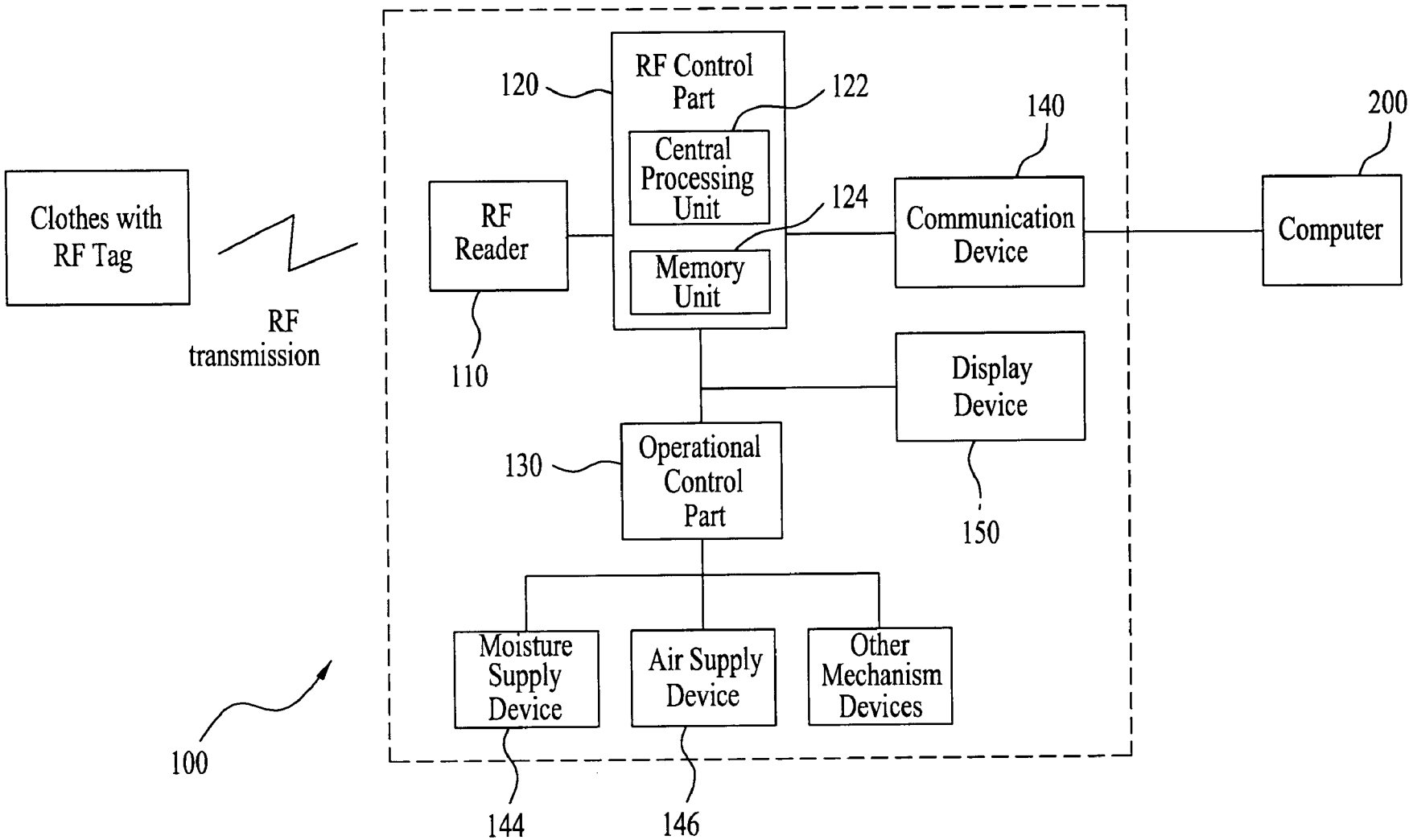
FIG. 2 is a conceptual diagram of the clothes treating apparatus.

FIG. 2 is a conceptual diagram of the clothes treating apparatus according to the exemplary embodiment. The clothes treating apparatus includes a RFID control part 120 and an operational control part 130. The RFID control part 120 controls a radio frequency identification function and the operational control part 130 controls each of the elements performing original functions of the clothes treating apparatus.

FIG. 2 shows that the RFID control part 120 and the operational control part 130 are provided independently and it is possible that a single control part should control the RFID function and the operation functions.

The elements controlled by the operational control part 130 may be the moisture supply device 144 or the air supply device 146, for example.

The operational control part 130 controls the moisture supply device 144 or the air supply device 146. If operation information of their operation conditions is transferred to the RFID control part 120, the RFID control part 120 stores the operation information in a memory unit 124.

The memory unit 124 is shown to be provided in the RFID control part 120 and it may be provided in the operational control part 130. That is, the position of the memory unit 124 may be variable only if it is capable of storing the operation information of the clothes treating apparatus.

A control of the RFID reader 110 and a communication device which will be described later and a processing of radio frequency identification may be stored in the memory unit 124 and may be performed by a RFID operation program of a central processing unit 122.

The RFID control part 120 includes the central processing unit 122 and the memory unit 124. The central processing unit 122 receives the information read by the RFID reader 110 and the operation information of the operational control part 130. In the memory unit 124 may be stored the read information, the operation information and the RFID operation program performed in the central processing unit 122.

The RFID control part 120 may be connected with a communication device 140 which transmitting the information read by the RFID reader 110 outside.

The RFID operation program performed in the central processing unit 122 supports a communication function in order for a communication device 140 to have a communication function. That is, the RFID operation program performed in the central processing unit 122 is an operation system which supports the communication function and operates the RFID control part 120.

The communication device 140 is connected with an external information receiving device such that the received information may be inspected via the external information receiving device. The external information receiving device may be a terminal for simply receiving and displaying the information or preferably a personal computer.

For example, the communication device 140 may be a LAN card capable of communicating with an external computer 200.

The LAN card is read by the RFID reader 110 and it is used as means of transmitting the information changed into TCP/IP protocol to the external computer 200.

Typically, TCP/IP (Transmission Control Protocol/Internet Protocol) may be used most as standard protocol for providing smooth communication via contact between systems in computer communication environments. The embodiment presents TCP/IP and other protocols may be also applicable.

The information read by the RFID reader 110 is not converted into TCP/IP yet and it is necessary to convert the information into TCP/IP in the RFID control part 120.

As mentioned above, the RFID control part 120 includes the central processing unit 122 converting the information read by the RFID reader 110 into TCP/IP and the memory unit 124 storing the operation program for the above conversion, with predetermined spare storage area.

The operation program is not an additional program and it may be included in the RFID operation program operated in the central processing unit 122 to perform radio frequency identification.

Also, the RFID operation program may have a function of converting the information received from the RFID reader 110 or the operational control part 130 into TCP/IP.

As a result, the RFID operation program operated in the RFID control part 120 converts the information read by the RFID reader 110 into TCP/IP and the converted TCP/IP is transmitted to the LAN card. The LAN card transmits the information on treatment states or positions of the clothes, which has been converted into TCP/IP, to the external computer 200.

A manager program should be installed in the external computer 200, for example, and the manager program allows users to inspect the information on the clothes.

Such the manager program may be provided with the users by the manufacturer of the clothes treating apparatus, together with the product, or the users may directly download the manager program on the internet.

If the communication device is connected with the internet, the user may identify the information stored in the clothes treating apparatus by remote control.

If the accommodation compartment 10 shown in FIG. 1 is provided in plural, the information on the kinds or conditions of the clothes accommodated in each of the accommodation compartments is a main object of inspection.

If the user possesses a large amount of clothes, the clothes which have been washed or dried may be a specific accommodation compartment. If the clothes which have been put on several times, not washing objects yet, are accommodated in another accommodation compartment, the user may identify them via the computer 200.

In addition, the clothes which have been put on more than one time, not washing objects, should be treated via the moisture or air supply process in the accommodation compartment and it is preferable that the user can inspect the information on the treatment of the clothes.

The treatment information is referenced to as information which is gained from the information on the operational conditions transmitted to the RFID control part 120 from the operational control part 130.

If the plurality of accommodation compartments is provided, such the information means the information on the clothes accommodated in a specific accommodation compartment, whether the steam or hot air is supplied to the accommodation compartment or how long the time passes after the steam or hot air is supplied to the accommodation compartment. The treatment information of each of the clothes may be analogized out of such the operation information. Thus, the treatment information of the clothes is the same concept with the operation information of the air supply device and the moisture supply device.

In other words, from the information whether the moisture is supplied by the moisture supply device 144 and the air supply device 146 and whether the drying using the air ventilation is complete, it may be determined whether the clothes are wearable immediately or which treatment process the clothes accommodated in the specific accommodation compartment need.

The clothes treating apparatus according to the exemplary embodiment may include a display device 150. If the clothes treating apparatus includes the display device 150 itself, the user may identify the information on the clothes via the display device 150, separate from the transfer of the information on the clothes via the communication device 140.

Figure 3:
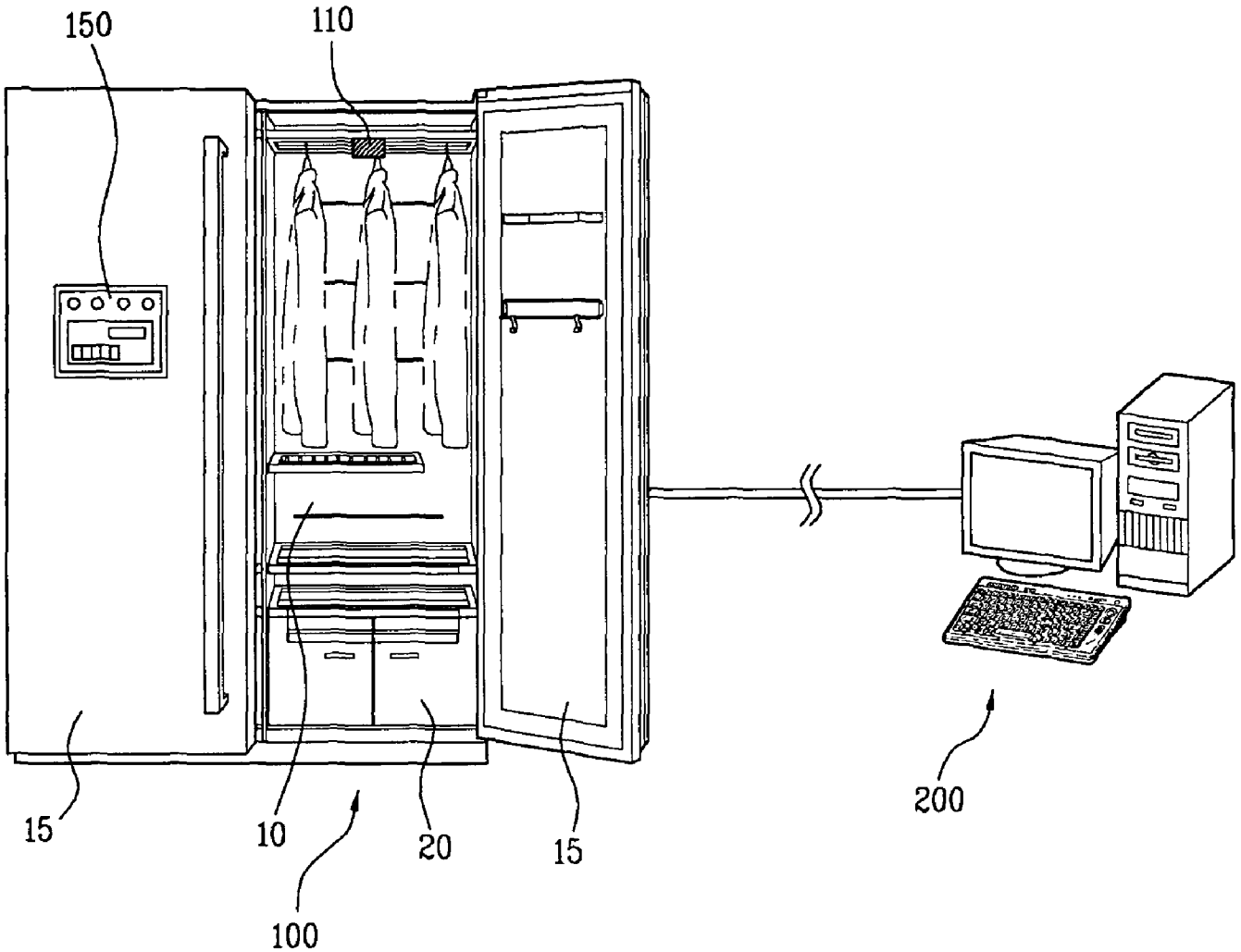
FIG. 3 is a diagram illustrating a configuration of the clothes treating apparatus.

FIG. 3 is a diagram illustrating an overall configuration of the clothes treating apparatus. according to the exemplary embodiment, the clothes treating apparatus includes two accommodation compartments 10 where clothes with RF tags attached thereto, respectively, are accommodated, a door 15 and a display device 150. The door 15 is coupled to a front of the clothes treating apparatus to selectively open and close the accommodation compartment 10. The display device 150 is installed on an outer surface of the door 15 to display the information read by the RFID reader 110. Alternatively, the clothes treating apparatus may be connected with the external computer 200 via a LAN wire.

A typical model of the display device 150 is a LCD device and the LCD device may be mounted in the outer wall surface of the door 15.

The RFID reader 110 may be mounted in the accommodation compartment. Each of the accommodation compartments 10 reads the information of the accommodated clothes by using the RFID reader 110 independently. Thus, it is preferable that each of the accommodation compartments 10 is configured of a shield box or shield room shape in order not to read the RF tag attached to the clothes accommodated in the other accommodation compartment.

A copper net, specifically, a mesh net made of copper may be embedded in an inner wall surface of each accommodation compartment 10 to embody each accommodation compartment 10 as a shield box or shield room.

If each accommodation compartment 10 is shield box or shield room shaped in such the method, the information of the clothes accommodated in one of the accommodation compartments may not be interfered with by the RDID reader 110 installed in the other accommodation compartment 10 or the RF tags of the clothes accommodated in the other accommodation compartment 10.

As a result, according to the embodiment shown in FIG. 3, it is preferable that one of the plural accommodation compartments may be shield room shaped. That is, because of the radio frequency identification created from the RF tags attached to the clothes accommodated in different accommodation compartments or the RFID reader 110 installed in different accommodation compartments, the reading failure of the information on the clothes accommodated in the specific accommodation compartment may be prevented.

As shown in FIG. 3, if more than two accommodation compartments are provided, the user identifies the states of the clothes accommodated in each accommodation compartment via the display device 150 or the external computer. Hence, the user moves the clothes which are washing objects to a specific accommodation compartment and the moisture may be supplied or air is ventilated to that accommodation compartment to treat the clothes.

Lack of information on clothes which have been treated, the clothes might be treated repeatedly only to waste of energy or time.

There may be a function of helping the user to remember the information of whether the clothes should be treated if the amount of the clothes is increasing and the time period of the clothes accommodation is long.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A clothes treating apparatus comprising:

at least one accommodation compartment where clothes are accommodated, with RFID tags attached to the clothes, respectively;

an air supply device ventilating air to the accommodation compartment;

an operational control part controlling the air supply device;

a RFID reader provided in the accommodation compartment to read information of the RFID tags attached to the clothes;

a RFID control part comprising a central processing unit receiving the information read by the RFID reader and operation information of the operational control part and a memory unit storing the operation information and a RFID operation program operated in the operational control part; and a display device for displaying information for a treatment state of the clothes based on the information read by the RFID reader from the RFID tags.

2. The clothes treating apparatus of claim 1, further comprising a communication device capable of transmitting the information read by the RFID reader to an external information receiving device, wherein the RFID operation program supports a communication function.

3. The clothes treating apparatus of claim 2, wherein the communication device is a LAN card via which the information read by the RFID reader is transmitted to the external information receiving device.

4. The clothes treating apparatus of claim 3, wherein the external information receiving device is a personal computer (PC).

5. The clothes treating apparatus of claim 4, wherein the LAN card is connected with the internet and the information stored in the RFID control part is inspected via the personal computer connected with the internet.

6. The clothes treating apparatus of claim 3, wherein the information stored in the RFID control part comprises information on positions of the clothes based on the information read by the RFID reader.

7. The clothes treating apparatus of claim 1, further comprising:

a moisture supply device controlled by the operational control part, the moisture supply device supplying moisture to the accommodation compartment.

8. The clothes treating apparatus of claim 7, wherein at least two accommodation compartments are provided and a RFID reader is installed in each of the at least two accommodation compartments.

9. The clothes treating apparatus of claim 8, wherein one of the at least two accommodation compartments is configured of a shield room.

10. The clothes treating apparatus of claim 1, wherein the display device is a liquid crystal display, the liquid crystal display mounted at a door opening and closing the accommodation compartment.

11. The clothes treating apparatus of claim 1, wherein at least two accommodation compartments are provided and a RFID reader is installed in each of the at least two accommodation compartments.

12. A clothes treating apparatus comprising:

at least one accommodation compartment where clothes are accommodated, with RFID tags attached to the clothes, respectively;

an air supply device ventilating air to the accommodation compartment;

a moisture supply device supplying moisture to the accommodation compartment;

a RFID reader installed in the accommodation compartment;

a control part storing information read by the RFID reader and operation information of the air supply device and the moisture supply device; and a display device for displaying information for a treatment state of the clothes based on the operation information of the air supply device and the moisture supply device.

13. The clothes treating apparatus of claim 12, wherein the moisture supply device is a steam generation device.

14. The clothes treating apparatus of claim 12, further comprising a communication device transmitting the information stored in the control part to an external information receiving device.

15. The clothes treating apparatus of claim 12, wherein the air supply device dehumidifies or heats air inside the accommodation compartment, with circulating the air.

16. A clothes treating apparatus comprising:

a clothing accommodation compartment;

an air supply device ventilating air to the clothing accommodation compartment;

an operational control part controlling the air supply device;

a RFID reader provided in the clothing accommodation compartment to read information from an RFID tag attached to at least one article of clothing in the clothing accommodation compartment;

a RFID control part receiving the information read by the RFID reader and operation information transmitted by the operational control part; and a display device that displays information regarding the location of the at least one article of clothing based on the information read by the RFID reader from the RFID tags and a treatment state of the at least one article of clothing based on the operation information of the air supply device.

* * * * *